United States Patent [19]

Mix

[11] Patent Number: 5,044,410

[45] Date of Patent: Sep. 3, 1991

[54] AUTOMATIC LATCHING SWINGING MAST MOUNT

[76] Inventor: P. Todd Mix, 12403 Maplewood Ave., Edmonds, Wash. 98020

[21] Appl. No.: 449,038

[22] Filed: Dec. 12, 1989

[51] Int. Cl.[5] ..... B63B 15/00

[52] U.S. Cl. ..... 114/90; 114/93

[58] Field of Search ..... 114/39.1, 89, 90, 91, 114/92, 93, 102

[56] References Cited

U.S. PATENT DOCUMENTS

| | | | |
|---|---|---|---|
| 270,358 | 1/1883 | Aldrich | 114/93 |
| 3,507,240 | 4/1970 | Butler | 114/39 |
| 4,112,861 | 9/1978 | Lewis | 114/91 |
| 4,655,154 | 4/1987 | Leonard | 114/93 |

FOREIGN PATENT DOCUMENTS 2700446 7/1978 Fed. Rep. of Germany .

*Primary Examiner*—Sherman Basinger
*Assistant Examiner*—Stephen P. Avila
*Attorney, Agent, or Firm*—Ward Brown; Robert W. Beach

[57] ABSTRACT

The foot of the mast of a sailboat is secured to a heel component which, in turn, is swingably mounted in a base component. The base component is stationarily mounted on the sailboat hull such that the mast is swingable between a generally horizontal position and an erect position. Mechanism is provided to latch the mast in its erect position automatically. Such latching mechanism is automatically releasable by pulling the mast toward its horizontal position. One sailor can step the mast by swinging it upward to latch it in erect position and thereafter fasten the conventional lines to secure the mast. Similarly, one sailor can unstep the mast by first unfastening the securing lines and thereafter pulling the mast downward to release the latching means. The force of the latching means can be adjusted.

10 Claims, 1 Drawing Sheet

Fig. 1.
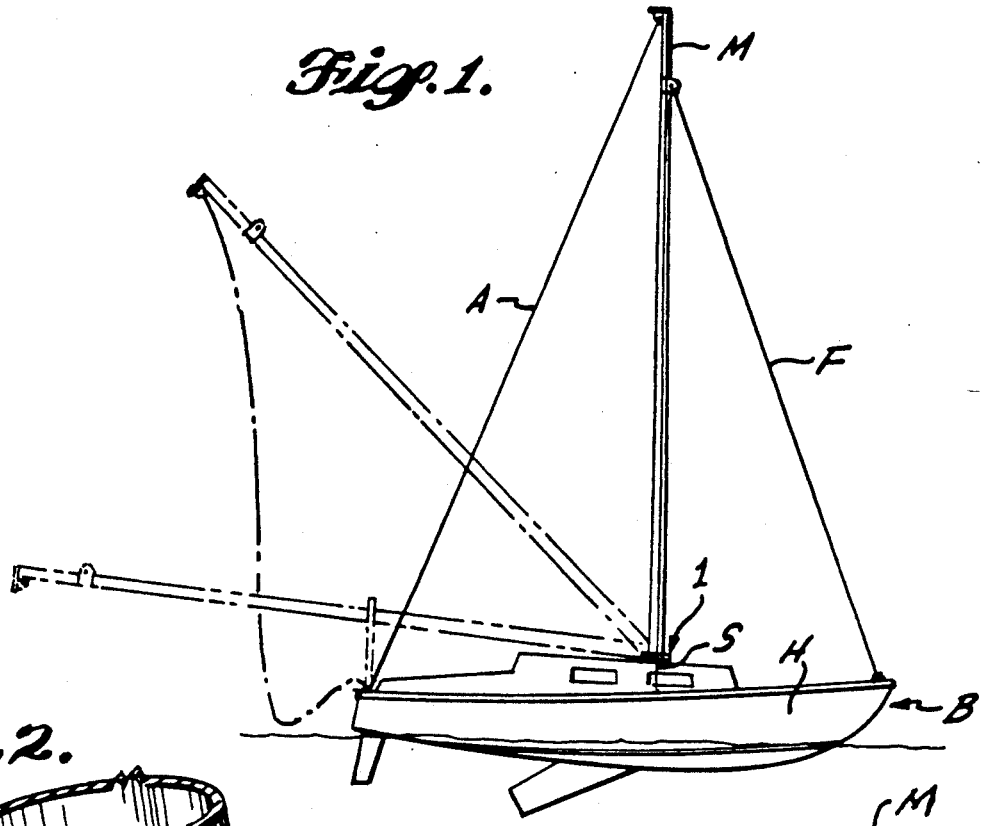
Fig. 2.
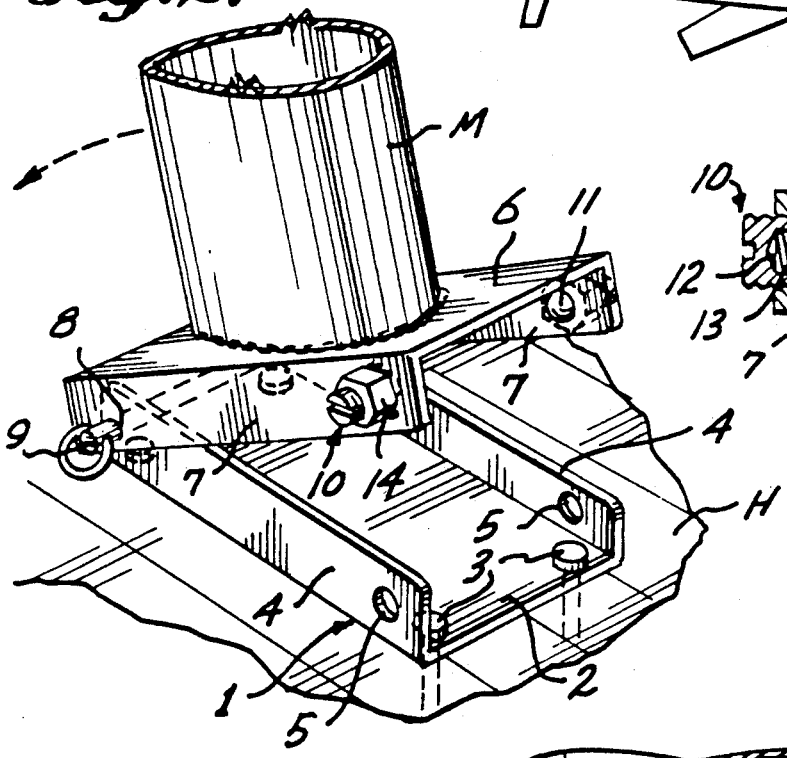
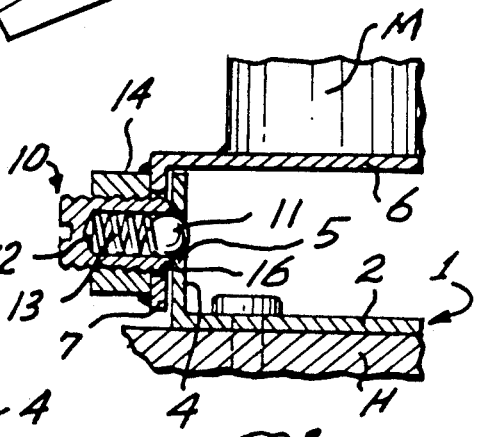
Fig. 4.
Fig. 3.
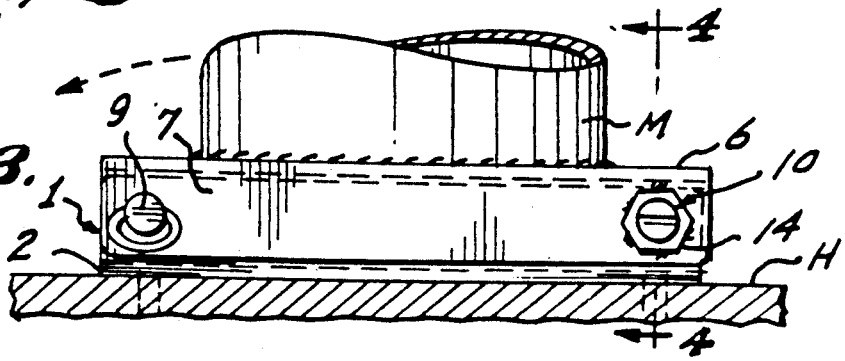

AUTOMATIC LATCHING SWINGING MAST MOUNT

BACKGROUND OF THE INVENTION

1. Field of the Invention

The present invention relates to mounting mechanism for the mast of a sailboat. More specifically, the present invention relates to a mast mount of the type mounting the mast for up and down swinging about a horizontal axis and enabling one sailor to step or unstep the mast.

2. Prior Art

The "Background of the Invention" section of U.S. Pat. No. 4,112,861 issued to Lewis discusses the problem with which the present invention is concerned, namely, the requirement that at least two people be available to step or unstep the mast of a conventional sailboat. FIG. 9 of the Lewis patent shows the essentially conventional components including a bottom channel or "base 48" and an upper component to which the foot of the mast is secured. The upper component is swingable relative to the channel about the horizontal axis of a pivot pin. Lewis proposed a specialized articulated mast and winch and cable system to allow the mast to be stepped or unstepped by one person.

U.S. Pat. No. 3,507,240 issued to Butler discloses another type of swinging mast mount including a bottom stationary channel component and an upper component to which the foot of the mast is secured and which is swingable about the horizontal axis of a rear pivot pin (element 56 as seen in FIG. 6 of the Butler patent). The Butler construction still requires at least two people to step the mast, one person to hold the mast erect while another person secures the lines to retain the mast in position. At least two people also would be required to unstep the mast safely.

SUMMARY OF THE INVENTION

The principal object of the present invention is to provide a mast mount for a sailboat allowing the mast to be stepped and unstepped safely and conveniently by one sailor.

It also is an object to provide such a mast mount in a form requiring minimal modifications to the mast or mast-securing equipment.

An additional object is to provide such a mount utilizing components of simple inexpensive construction, but sturdy and reliable over a long period of use.

Another object is to provide such a mast mount in a form usable for retrofit as well as new construction.

In the preferred embodiment of the present invention, the foregoing objects are accomplished by providing a mast mount including a base component stationarily secured to the hull of the sailboat, a heel component to which the foot of the mast is secured and which is swingably mounted on the base component, and mechanism for automatically latching the heel component relative to the base component with the mast erect by simply swinging the mast to its erect position. With the mast automatically held in such position, one sailor can secure the mast by fastening the conventional lines extending from the sailboat hull to the upper portion of the mast. When it is desired to unstep the mast, such lines can be unfastened so that the mast remains in its erect position only by the action of the latching mechanism. Such mechanism can be released by simply pulling on the mast to swing it downward to a horizontal position. Preferably, the force of the latching mechanism can be adjusted so as to maintain the mast reliably in its erect position while the supporting lines are fastened or unfastened while still allowing the force of the latching mechanism to be overcome when the supporting lines are unfastened by one sailor manually swinging the mast.

BRIEF DESCRIPTION OF THE DRAWINGS

FIG. 1 is a somewhat diagrammatic side elevation of a sailboat having an automatic latching swinging mast mount in accordance with the present invention.

FIG. 2 is a fragmentary top perspective of the preferred form of automatic latching swinging mast mount in accordance with the present invention.

FIG. 3 is an enlarged fragmentary side elevation of the mast mount of FIG. 2, and FIG. 4 is a further enlarged fragmentary vertical section along line 4—4 of FIG. 3.

DETAILED DESCRIPTION

With reference to FIG. 1, the present invention is intended to be used with a sailboat B of conventional construction including the tall, normally upright mast M supported on the hull H. For sailing, the mast is maintained upright or erect by several lines such as the forestay F, aft stay A and port and starboard shrouds S. At other times, it is desirable to unstep the mast which includes unfastening the lines and swinging the mast downward to substantially horizontal position, as indicated in broken lines in FIG. 1, such as for land transport or storage or to allow passage beneath a low bridge. Mounts permitting swinging movement of the mast are known, but at least two people are required to unstep the mast safely, one to hold the mast erect while the second unfastens the supporting lines. Similarly, two people are required to step the mast, one to hold the mast erect while the second fastens the supporting lines.

With reference to FIGS. 2, 3 and 4, the mast mount 1 in accordance with the present invention allows the mast to be stepped or unstepped by one sailor. In the preferred embodiment, such mount includes a base component or bottom channel 2 having a horizontal web stationarily secured to the boat hull H such as by pins or bolts 3. The bottom channel has transversely spaced upright flanges 4 with registered holes 5 toward the leading end of the channel and corresponding registered holes toward the trailing end.

Mount 1 also includes heel component or top channel 6 having a normally horizontal web to which the foot of the mast M is secured such as by welding. Top channel 6 has laterally spaced, downward-projecting flanges 7 with registered holes 8 in the rear end portions thereof. Holes 8 can be positioned to be aligned with the rear holes in the upstanding flanges 4 of the bottom channel 2. A pivot pin 9 is inserted into the aligned rear holes of the top and bottom channels so as to permit swinging movement of the top channel relative to the bottom channel, corresponding to down and up swinging of the mast. If desired, the pivot pin 9 can be removed, whereupon the mast can be completely separated from the boat hull H.

With the mast erect, the web of the top channel 6 closely overlies the top edges of the upstanding flanges 4 of the bottom channel 2, and the downward-projecting flanges 7 of the top channel extend close alongside the flanges 4 of the bottom channel. In accordance with the present invention, mechanism is provided to latch the channels together, namely, a ball plunger 10 mounted toward the leading end portion of each of the top channel flanges 7 with its spring-loaded ball 11 positioned to fit in the front hole 5 of the corresponding flange 4 of the bottom channel when the mast is erect.

More specifically, with reference to FIG. 4, the ball plungers can be of the type sold under the trademark "Northwestern" by Jergens, Inc. of Cleveland, Ohio. Each plunger includes an externally threaded stud 12 having a central cavity 12' in which a compression spring 13 and the ball 11 are received. Stud 12 is screwed into a nut 14 fixed to the exterior of its flange 7 such as by welding. Each stud 12 extends through a hole 15 in its flange 7 coaxial with the bore of its nut 14, but larger so as to permit in and out movement of the stud by turning it in its nut. The ball 11 is movable inward into the cavity 12' of the stud 12 against the force of the compression spring 13. Outward movement of the ball is limited by engagement against an annular lip 16 at the inner end of the stud.

When it is desired to step the mast, one sailor can swing it upward from its horizontal position. As the mast approaches vertical position, the spring-loaded balls 11 engage against the upstanding flanges 4 of the bottom channel 2 and, when a predetermined torque is exceeded, are forced inward into the cavities 12' against the combined forces of the springs 13. When the mast reaches its vertical or erect position, the balls 11 snap outward into the holes 5 of flanges 4. The sailor then can safely release the hold on the mast while fastening and/or adjusting the forestay, aft stay and port and starboard shrouds.

Similarly, when it is desired to unstep the mast, the securing lines can safely be loosened and unfastened because the mast is normally latched in erect position by engagement of the spring-loaded balls 11 in the holes 5. Nevertheless, with the lines unfastened, the sailor can pull rearward on the mast which forces the balls inward into their cavities 12' and permits rearward swinging of the mast relative to the stationary bottom channel 2.

In the illustrated embodiment, the studs 12 are turnable in their mounting nuts 14 for moving the studs in and out relative to the upstanding flanges 4 of the bottom channel 2. Turning a stud in one direction moves it inward such that its ball 11 seats more fully into the corresponding hole 5, thereby requiring greater force to be exerted in order to move the ball inward into its cavity sufficiently that the top channel can be moved to its normal latched position or from such latched position to its released position. Turning of the stud 12 in the opposite direction moves it outward relative to the corresponding flange 4 of the bottom channel 2 such that less of the ball 11 extends into the corresponding hole 5 and a lesser force is required to move it inward into its cavity sufficiently to allow swinging movement of the top channel relative to the bottom channel. The force required to latch or release the top channel to or from the bottom channel should be adjusted such that the channels are maintained reliably latched together without other means of support for the mast while permitting latching and releasing of the channels by one sailor swinging the mast.

I claim:

1. In a sailboat having a hull, a mast-mounting base component secured to the hull, a mast, a mast mounting heel component secured to the mast, pivot means mounting the heel component for swinging relative to the base component so as to permit up and down swinging of the mast between a generally horizontal position and an erect position and support lines normally connected between the hull and the mast for normally maintaining the mast in its erect position but disconnectible to permit movement of the mast between its erect position and its generally horizontal position the improvement comprising mechanical latching means for automatically latching the mast in its erect position by swinging of the mast to such position for maintaining the mast in erect position while the supporting lines are connected or disconnected.

2. In the sailboat defined in claim 1, the latching means including means for mechanically interconnecting the base component and the heel component by swinging the mast from its generally horizontal position to its erect position.

3. In the sailboat defined in claim 1, the latching means being automatically releasable without structural damage by manually moving the mast from its erect position toward its horizontal position with the supporting lines disconnected.

4. In the sailboat defined in claim 1, the latching means including means maintaining the mast in its erect position until torque in excess of a predetermined release torque tending to swing the mast from its erect position toward its generally horizontal position is applied with the supporting lines disconnected whereupon the latching means automatically releases so as to free the mast for movement toward its generally horizontal position.

5. In the sailboat defined in claim 4, the latching means including means for adjusting the predetermined release torque.

6. In the sailboat defined in claim 4, the base component and the heel component having respective flange portions positioned close alongside each other when the mast is in its erect position, and the latching means including a spring-loaded member carried by one of said flange portions and interfittable with the other of said flange portions for latching the base component to the heel component.

7. In the sailboat defined in claim 6, the latching means including a plunger having an externally threaded stud with an internal cavity in which the spring-loaded member is received and an internally threaded mounting member fixed to one of the component flange portions, said mounting member threadedly receiving said stud such that said stud is turnable in said mounting member for moving the spring-loaded member toward and away from the other of the component flange portions.

8. In the sailboat defined in claim 1, the base component including a bottom channel having a horizontal web secured to the sailboat hull and transversely spaced upstanding flanges, the heel component including a top channel having a normally horizontal web to which the mast is secured, said top channel web being positioned to closely overlie the top edges of the upstanding flanges of the bottom channel when the mast is erect, said top channel having downward-extending flanges positioned close alongside the bottom channel upstanding flanges when the mast is erect, the pivot means including a pivot pin pivotally mounting the heel component on the base component, and the latching means including means for automatically latching the heel component to the base component by swinging the mast from its generally horizontal position to its erect position for corresponding swinging of the heel component relative to the base component.

9. In the sailboat defined in claim 8, at least one of the flanges of one of the channels having a recess, and a plunger mounted on the flange close alongside such one flange, said plunger including a spring-loaded member in position to engage in said recess when the mast is erect, and means biasing said spring-loaded member into said recess, said spring-loaded member being retractable from said recess against the force of said biasing means by swinging movement of the mast from its erect position toward its generally horizontally position.

10. In the sailboat defined in claim 9, means for adjusting the extent to which the spring-loaded member fits in the recess for adjusting the force required to retract the spring-loaded member from the recess sufficiently to permit movement of the mast from its erect position.

* * * * *